US007665720B2

(12) United States Patent
Mori et al.

(10) Patent No.: US 7,665,720 B2
(45) Date of Patent: Feb. 23, 2010

(54) PAPER SHEET PROCESSING APPARATUS

(75) Inventors: Takao Mori, Kawasaki (JP); Hideaki Watanabe, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 450 days.

(21) Appl. No.: 11/641,693

(22) Filed: Dec. 20, 2006

(65) Prior Publication Data

US 2007/0158893 A1 Jul. 12, 2007

(30) Foreign Application Priority Data

Jan. 10, 2006 (JP) ..... 2006-002725

(51) Int. Cl.
*B65H 39/04* (2006.01)

(52) U.S. Cl. ..... 270/52.16; 270/52.14; 270/52.04; 270/52.18; 270/58.01; 270/58.07; 270/58.29; 270/58.33; 270/58.34

(58) Field of Classification Search ..... 270/52.02, 270/52.03, 52.04, 52.14, 52.16, 52.18, 58.01, 270/58.07, 58.29, 58.33, 58.34; 53/504, 53/540

See application file for complete search history.

(56) References Cited

U.S. PATENT DOCUMENTS 4,388,994 A * 6/1983 Suda et al. ..... 209/564
4,412,411 A * 11/1983 Hashimoto et al. ..... 53/587
5,414,974 A * 5/1995 Van de Ven et al. ..... 53/399
5,426,921 A * 6/1995 Beckmann ..... 53/566
2005/0060956 A1 * 3/2005 Yui ..... 53/399

FOREIGN PATENT DOCUMENTS

| | | |
|---|---|---|
| EP | 1 204 077 A2 | 5/2002 |
| EP | 1 331 612 A2 | 7/2003 |
| GB | 2 128 592 A | 5/1984 |
| JP | 07-073553 | 3/1995 |

OTHER PUBLICATIONS

European Search Report dated Feb. 5, 2008 for Appln. No. 06025963.7-2211.

* cited by examiner

*Primary Examiner*—Gene Crawford
*Assistant Examiner*—Leslie A Nicholson, III
(74) *Attorney, Agent, or Firm*—Pillsbury Winthrop Shaw Pittman, LLP

(57) ABSTRACT

A paper sheet processing apparatus includes a plurality of bundling devices, and a plurality of chute devices which temporarily hold bundles, which are bundled by the bundling devices. A second transfer conveyor, which is slower than a first transfer conveyor, is disposed on a downstream side of the first conveyor. A transmission sensor, which detects abnormality in length of the bundle, is provide along the second conveyor. The distance from a release position of the bundle from the chute device, which is located on a most downstream side, to a terminal end of the first conveyor and the length of the second conveyor are set such that a time until the bundle, which is released from the most downstream chute device, is transferred onto the second conveyor is longer than at least a time until the bundle, which is transferred from the first conveyor, passes through the second conveyor.

4 Claims, 4 Drawing Sheets

Speed of conveyance : 666mm/s

| Stacking device | Transfer distance | Transfer time theoretical value Tns(s) (n:1~4) | Post-correction transfer time Tns(s) (n:1~4) |
|---|---|---|---|
| Valid notes 1 | 110 | 0.17 | 1.47 |
| Valid notes 2 | 620 | 0.93 | 2.23 |
| Invalid notes 1 | 1165 | 1.75 | 3.05 |
| Invalid notes 2 | 1655 | 2.48 | 3.78 |

PAPER SHEET PROCESSING APPARATUS

CROSS-REFERENCE TO RELATED APPLICATIONS

This application is based upon and claims the benefit of priority from prior Japanese Patent Application No. 2006-002725, filed Jan. 10, 2006, the entire contents of which are incorporated herein by reference.

BACKGROUND OF THE INVENTION

1. Field of the Invention

The present invention relates to a paper sheet processing apparatus which inspects paper sheets such as securities and bundles them by paper bands in accordance with kinds, and inspects the bundled states of paper sheets and discharges the bundles of paper sheets.

2. Description of the Related Art

There is known a conventional paper sheet processing apparatus which processes paper sheets such as securities. A plurality of paper sheets to be processed are input as a batch, and the input paper sheets are transferred along a transfer path one by one. The quality (shape, degree of damage, print state, stain, etc.) of each paper sheet, which is transferred, is inspected, and paper sheets that are determined to be circulatable by the inspection result (hereinafter referred to as "valid notes"), paper sheets that are determined to be non-circulatable by the inspection result (hereinafter referred to as "invalid notes") and paper sheets that are treated as samples for human inspection (hereinafter referred to as "audit notes") are sorted and stacked in sorting sections to which these paper sheets are assigned.

This apparatus includes a plurality of bundling sections which bundle the valid notes, invalid notes and audit notes, which are sorted and stacked in the sorting sections in accordance with the inspection result, as described above, in units of, e.g. 100 notes by paper bands. The bundles which are obtained by the bundling sections are discharged to the outside of the apparatus via a common conveyor. The conveyor is provided to extend under the bundling sections along the direction of arrangement of the bundling sections.

In this apparatus, when the bundles are discharged from the apparatus via the conveyor, the length of the bundle in the direction of conveyance of the bundle is detected and compared with a reference value, and a bundle in an unwanted bundled state is rejected. For example, in an apparatus that is disclosed in Jpn. Pat. Appln. KOKAI Publication No. 7-73353, the time of passage of the bundle, which is conveyed at a constant speed, is detected by using two transmission sensors which are spaced apart in a direction perpendicular to the direction of conveyance of the bundle. The detected time of passage is measured by using fixed clock pulses, and compared with a preset reference value. Thereby, abnormality in the length of the bundle in the direction of conveyance is detected.

For example, in a case where the speed V of conveyance of the bundle by the conveyor is 666 [mm/s] and the length Ls of the bundle in the direction of conveyance is 160 [mm], the time T [s] during which the transmission sensors detect the bundle is expressed by $$T=Ls/V=0.240\ [s]=240\ [ms].$$

If the time T [s] is measured by using clock pulses CK of, e.g. 1 [ms] cycle, the measured value Lc is given by $$Lc=T/CK=240\ [ms]/1\ [ms]=240.$$

Thus, abnormality in the length of the bundle can be detected by comparing the measured value Lc with a reference value.

At this time, the precision of measurement of the length of the bundle becomes higher as the measured value Lc for the detection of the bundle is higher, and the precision of measurement varies depending on the distance Ac of movement of the bundle during one clock pulse, i.e.

$$Ac=V\times CK=0.666\ [mm].$$

In other words, the precision of measurement becomes higher as the distance Ac of movement in one clock pulse is shorter.

Although the precision of measurement can be enhanced by decreasing the speed of conveyance of the bundle by the conveyor, the processing performance of the apparatus as a whole deteriorates if the speed of the conveyor is lowered. In usual cases, in consideration of the processing performance of the apparatus, the speed of conveyance of the conveyor is set at a maximum value within such a range that bundles that are formed by bundling sections can normally be conveyed to the outside of the apparatus.

In order to enhance the precision of measurement while maintaining the speed of conveyance of the bundle by the conveyor, it is thinkable to shorten the cycle of the above-mentioned clock pulse CK. In this method, however, such a problem arises that the load on the system, which is needed for arithmetic operations, increases.

BRIEF SUMMARY OF THE INVENTION

The object of the present invention is to provide a paper sheet processing apparatus which can enhance the precision of measurement of a bundled state of paper sheets, without lowering the processing performance of the apparatus.

In order to achieve the object, according to an aspect of the present invention, there is provided a paper sheet processing apparatus comprising: a take-out/transfer unit which takes out input paper sheets one by one onto a transfer path and transfers the paper sheets; a paper sheet inspection unit which inspects the paper sheets that are transferred by the take-out/transfer unit; a sorting/stacking unit which sorts and stacks the paper sheets, which are transferred via the transfer path, on the basis of an inspection result in the paper sheet inspection unit; a plurality of bundling units which bundle the paper sheets, which are sorted and stacked by the sorting/stacking unit, in units of a predetermined number of paper sheets; a plurality of temporary hold units which receive and temporarily hold bundles that are formed by the plurality of bundling units; a first transfer conveyor which is provided to extend in a direction of arrangement of the plurality of temporary hold units, receives the bundle that is held by each of the temporary hold units, and conveys the bundle; a second transfer conveyor which receives the bundle that is conveyed by the first transfer conveyor, and conveys the bundle; and a bundle inspection unit which inspects a bundled state of the bundle that is conveyed by the second transfer conveyor, wherein running speeds of the first and second transfer conveyors are set such that a speed of conveyance of the bundle by the second transfer conveyor is lower than a speed of conveyance of the bundle by the first transfer conveyor, and a distance from a position of reception of the bundle from the temporary hold unit, which is located on a most downstream side, to a terminal end of the first transfer conveyor and a length of the second transfer conveyor in a direction of conveyance are set such that a time from when the bundle is transferred onto the first transfer conveyor from the temporary hold unit, which is located on a most downstream side in the direction of arrangement along a direction of conveyance of the bundle by the first transfer conveyor, to when the bundle is passed through the first transfer conveyor and transferred onto the second transfer conveyor is longer than a time from when the bundle is transferred onto the second transfer conveyor to when the bundle is completely passed through the second transfer conveyor.

According to another aspect of the present invention, there is provided a paper sheet processing apparatus comprising: a take-out/transfer unit which takes out input paper sheets one by one onto a transfer path and transfers the paper sheets; a paper sheet inspection unit which inspects the paper sheets that are transferred by the take-out/transfer unit via the transfer path; a sorting/stacking unit which selectively sorts and stacks the paper sheets, which are transferred via the transfer path, into a plurality of sorting sections, which are juxtaposed along a direction of transfer of the paper sheets, on the basis of an inspection result in the paper sheet inspection unit; a plurality of bundling units which bundle the paper sheets, which are sorted and stacked into the plurality of sorting sections, in units of a predetermined number of paper sheets; a plurality of temporary hold units which receive and temporarily hold bundles that are formed by the plurality of bundling units; a first transfer conveyor which is provided to extend under the plurality of temporary hold units in a direction of arrangement of the plurality of temporary hold units, and conveys the bundle that is released from each of the temporary hold units and placed on the first transfer conveyor; a second transfer conveyor which is disposed on a downstream side of the first transfer conveyor in a direction of conveyance of the first transfer conveyor in succession with the first transfer conveyor, and further conveys the bundle, which is transferred from the first transfer conveyor, at a speed of conveyance that is lower than a speed of conveyance of the bundle by the first transfer conveyor; a memory unit which stores a pre-measured actual time until the bundle that is released from the temporary hold unit, which is located on a most downstream side in the direction of conveyance, is transferred onto the second transfer conveyor; a sensor which detects passage of the bundle which is conveyed by the second transfer conveyor; a length detection unit which detects a length of the bundle in the direction of conveyance on the basis of a time during which the sensor detects the passage of the bundle; and a bundle inspection unit which inspects a bundled state of the bundle on the basis of a detection result by the length detection unit, wherein a distance from a position of reception of the bundle from the temporary hold unit, which is located on the most downstream side, to a terminal end of the first transfer conveyor and a length of the second transfer conveyor in a direction of conveyance are set such that a time until the bundle, which is transferred from the first transfer conveyor onto the second transfer conveyor, is completely passed through the second transfer conveyor is shorter than a prestored time in the memory unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will now be described in detail with reference to the accompanying drawings.

Figure 1:
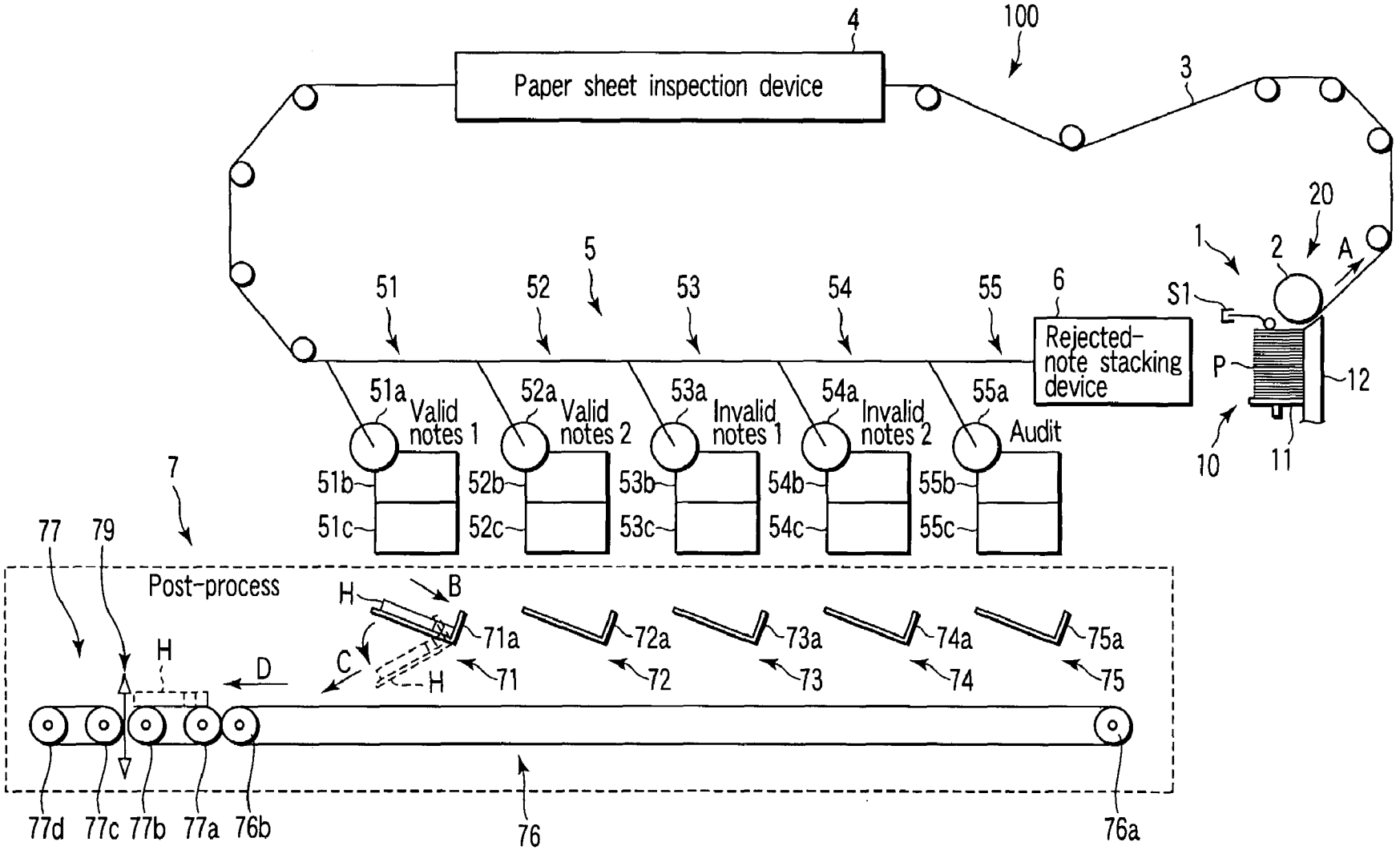
FIG. 1 is a schematic view of a paper sheet processing apparatus according to an embodiment of the present invention.

FIG. 1 schematically shows a paper sheet processing apparatus 100 (hereinafter referred to simply as "processing apparatus 100") according to an embodiment of the invention.

The processing apparatus 100 includes a take-out device 1 which takes out, one by one, a plurality of paper sheets P which have been input as a batch; a transfer path 3 which transfers the paper sheets P which have been taken out by the take-out device 1; a paper sheet inspection device 4 which inspects the paper sheets P which are transferred via the transfer path 3; a stacking/bundling device 5 (sorting/stacking units, bundling units) which sorts and stacks paper sheets P on the basis of an inspection result by the paper sheet inspection device 4 and bundles the sorted/stacked paper sheets P in units of a predetermined number of paper sheets; and a rejected-note stacking device 6 which stacks rejected notes (to be described later).

The take-out device 1 includes a feed unit 10 which successively feeds, e.g. 1000 paper sheets P that have been input as one input unit, to a take-out position; and a take-out unit 20 which takes out the paper sheets P, which are successively fed to the take-out position, onto the transfer path 3 one by one at regular intervals.

The feed unit 10 includes a backup plate 11, on which the input paper sheets P are placed in a stacked state; a support member 12 which vertically movably supports the backup plate 11; a take-out position detection sensor S1 which detects that an uppermost one of the paper sheets P stacked on the backup plate 11 is placed at a take-out position; and a driving mechanism (not shown) which vertically moves the backup plate 11 so that the uppermost paper sheet P can be detected by the take-out position detection sensor S1.

The take-out unit 20 includes a take-out rotor 2 which rotates in contact with the paper sheet P which is fed to the take-out position by the feed unit 10. The take-out rotor 2 rotates in the state in which a negative pressure is caused to occur on its peripheral surface and the paper sheet P at the take-out position is sucked on the peripheral surface, thereby feeding the paper sheet P at the take-out position onto the transfer path 3. The paper sheets P, which have been taken out onto the transfer path 3 by the take-out rotor 2, are successively conveyed at regular intervals.

The paper sheet inspection device 4 inspects, for example, the print state of the paper sheet P that is conveyed via the transfer path 3. As a result of the inspection, a paper sheet P in a normal print state is determined to be a valid note, a paper sheet P in an abnormal print state is determined to be an invalid state, and a paper sheet P, which is conveyed in an abnormal manner or is conveyed together with another paper sheet P, is determined to be a rejected note. The paper sheet P, which is determined to be the rejected note, is conveyed to the rejected-note stacking device 6 which is provided at the terminal end of the transfer path 3. Paper sheets P, which are randomly chosen from the valid and invalid notes, are processed as audit notes which are to be subjected to human inspection.

The stacking/bundling device 5 includes two sorting sections 51 and 52 which alternately stack and bundle paper sheets P, which are determined to be valid notes by the paper sheet inspection device 4; two sorting sections 53 and 54 which alternately stack and bundle invalid notes; and one sorting section 55 which stacks and bundle audit notes.

The five sorting sections 51 to 55 have the same structure, and include vane wheels 51*a* to 55*a* which rotate while receiving paper sheets P that are fed from the transfer path 3 in a distributed fashion; stacking units 51*b* to 55*b* which stack the paper sheets P that are received via the vane wheels 51*a* to 55*a*; and bundling devices 51*c* to 55*c* which bundle a predetermined number of stacked paper sheets P by a paper band.

Attention is now paid to the most upstream sorting section 51 in the direction of transfer of paper sheets P. Paper sheets P (valid notes in this case), which are assigned to the sorting section 51 and fed via the transfer path 3, are received between vanes (not shown) of the vane wheel 51*a*. At this time, the vane wheel 51*a* rotates in sync with the transfer timing of paper sheets P, and receives the paper sheets P and stacks them in the stacking unit 51*b* while absorbing kinetic energy of the paper sheets P that are conveyed at high speed.

When a predetermined number (100 in this embodiment) of paper sheets P are stacked in the stacking unit 51*b*, the bundling device 51*c* bundles the 100 paper sheets P by a paper band and forms a bundle of paper sheets P. Attributes of bundled paper sheets P, an apparatus number, etc. are printed on the paper band that is used at this time. The bundling device 51*c* bundles the stacked paper sheets P by winding the paper band around the stacked paper sheets P in their transverse direction.

Similarly, in each of the other sorting sections 52, 53, 54 and 55, a predetermined number of paper sheets P are stacked and bundled by the paper band, and bundles of respective kinds of paper sheets P are formed. At this time, the sorting sections 51 and 52 alternately stack and bundle 100 valid notes, and the sorting sections 53 and 54 alternately stack and bundle 100 invalid notes. The timing of forming bundles in the five sorting sections 51 to 55 varies depending on the kinds and number of paper sheets P that are input to the processing apparatus 100. Thus, the bundles, which are formed at different timings in the sorting sections 51 to 55, are transferred to a post-process and synchronized in timing, and the bundles are fed out of the processing apparatus 100.

In the post-process, bundles H, which are formed in the bundling devices 51*c* to 55*c* of the sorting sections 51 to 55, are temporarily held and are released onto a conveyor at such a timing that no interference occurs. The bundles are then discharged from the processing apparatus 100 by the conveyor. To be more specific, the bundles H, which are released from the sorting sections 51 to 55, are released onto an upstream-side first transfer conveyor 76 (to be described later) at such a timing that two bundles H are not released at the same time. In addition, the bundled state of each bundle H is inspected while the bundle H is being conveyed by a second transfer conveyor 77, and only normal bundles H in the normal bundled state are discharged from the apparatus.

Five chute devices 71, 72, 73, 74 and 75 (temporary hold units), which can receive and temporarily hold the bundles H formed in the respective sorting sections, are provided vertically below the five sorting sections 51 to 55. The five chute devices 71 to 75 have the same structure.

Further, below the five chute devices 71 to 75, there is provided a first transfer conveyor 76 that conveys at a relatively high speed the bundles H which are released from the chute devices 71 to 75 at proper timing. The first transfer conveyor 6 is provided to extend below the chute devices 71 to 75 along the direction of arrangement of the chute devices 71 to 75 (in the right-and-left direction in FIG. 1).

On the downstream side in the direction of conveyance of the first transfer conveyor 76, a second transfer conveyor 77 is provided in succession with the first transfer conveyor 76. The second transfer conveyor 77 conveys the bundles H at a speed that is lower than, at least, the speed of conveyance of the first transfer conveyor 76. The bundled state of the bundle H, which is conveyed by the second transfer conveyor 77 at a relatively low speed, is inspected by means of a transmission sensor 79.

For example, the chute device 71 (to be described representatively) provided in association with the most downstream sorting section 51 includes a tray 71*a* having a stopper at a right end in FIG. 1 and an opened upper side; and a driving mechanism (not shown) for rotating the tray 71*a* between a temporary hold position (indicated by a solid line in FIG. 1) and a release position (indicated by a broken line in FIG. 1).

In the state in which the tray 71*a* is rotated to the temporary hold position, the bundle H that is formed by the bundling device 51*c* of the sorting section 51 is released in a direction B indicated in FIG. 1, and received on the tray 71 with an end portion of the bundle H in the direction B abutting upon the stopper. The bundle H is temporarily held before it is released onto the first transfer conveyor 76. The tray 71*a* is rotated to the release position on the basis of a trigger signal (to be described later), and the direction of movement of the temporarily held bundle H is turned. Thus, the bundle H is released in a direction C onto the first transfer conveyor 76.

The first transfer conveyor 76 functions as a common conveyor for all the chute devices 71 to 75. The first transfer conveyor 76 receives bundles H which are released from the sorting sections 51 to 55 via the chute devices 71 to 75, and conveys the bundles H in a direction D in FIG. 1. Preferably, the speed of conveyance of the bundle H by the first transfer conveyor 76 should be set at a maximum value within a tolerable range in order to enhance the processing performance of the processing apparatus 100. In this embodiment, the speed of conveyance of the bundle H by the first transfer conveyor 76 is set at 666 [mm/s].

The second transfer conveyor 77, which is disposed on the downstream side of the first transfer conveyor 76 in succession with the first transfer conveyor 76, includes an upstream conveyor 77U (first conveyor) which is disposed on the downstream side of the first transfer conveyor 76 in succession with the first transfer conveyor 76; a downstream conveyor 77L (second conveyor) which is disposed on the downstream side of the upstream conveyor 77U in succession with the upstream conveyor 77U with a gap provided between the upstream conveyor 77U and downstream conveyor 77L; and a coupling device 78 (to be described later) which couples the two conveyors 77U and 77L so as to synchronously drive the two conveyors 77U and 77L at the same speed. The transmission sensor 79 is disposed in the gap between the upstream conveyor 77U and downstream conveyor 77L. In this embodiment, the speed of conveyance of the bundle H by the second conveyor 77 is set at 333 [mm/s].

Figure 2:
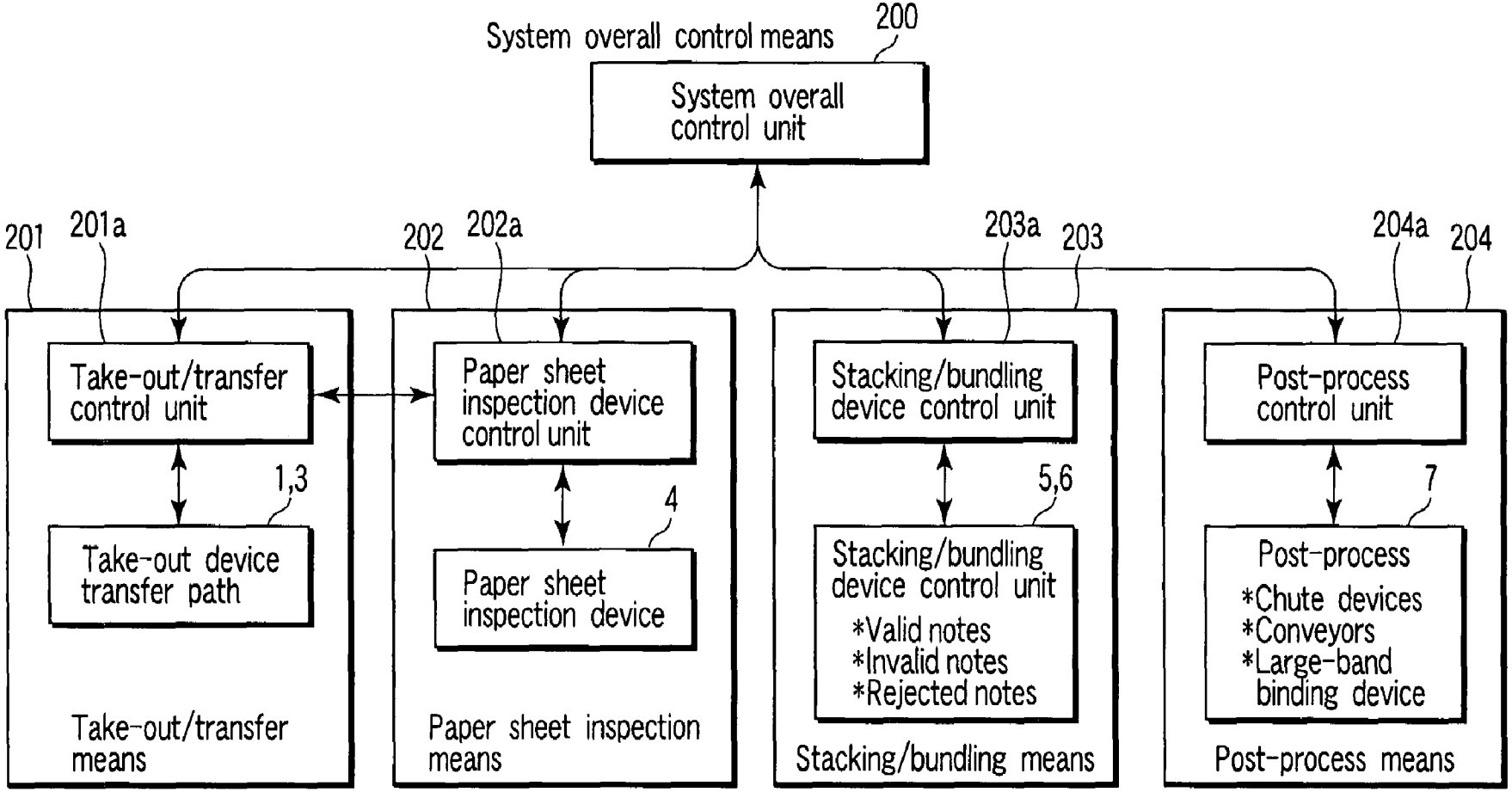
FIG. 2 is a block diagram of a control system which controls the operation of the apparatus shown in FIG. 1.

FIG. 2 is a block diagram of a control system which controls the operation of the processing apparatus 100 having the above-described structure. The processing apparatus 100 includes take-out/transfer means 201, paper sheet inspection means 202, stacking/bundling means 203, post-process means 204, and a system overall control unit 200 which executes an overall control of these control means 201, 202, 203 and 204.

The take-out/transfer means 201 includes the take-out device 1, the transfer path 3 and a take-out/transfer control unit 201*a* which controls the operations of these mechanisms. The take-out/transfer control unit 201*a* is connected to a paper sheet inspection device control unit 202*a* (to be described later) and the system overall control unit 200.

The take-out/transfer control unit 201*a* receives from the system overall control unit 200 a permission signal for the start of take-out of the paper sheet P, and controls the take-out device 1 so as to take out paper sheets P one by one onto the transfer path 3. In addition, in accordance with the inspection result in the paper sheet inspection device control unit 202*a*, the take-out/transfer control unit 201*a* sorts and stacks the paper sheets P, which are taken out onto the transfer path 3, into the sorting sections 51 to 55. When 100 paper sheets P are stacked in each of the stacking units 51*b* to 55*b* of the sorting sections 51 to 55, the take-out/transfer control unit 201*a* informs the system overall control unit 200 of the completion of stacking of 100 paper sheets P.

The paper sheet inspection means 202 includes the paper sheet inspection device 4 and paper sheet inspection device control unit 202*a* which controls the operation of the paper sheet inspection device 4. The paper sheet inspection device control unit 202*a* is connected to the take-out/transfer control unit 201*a* and the system overall control unit 200. The paper sheet inspection device control unit 202*a* sends inspection results relating to the paper sheets P, which are inspected by the paper sheet inspection device 4, to the take-out/transfer control unit 201*a* and the system overall control unit 200.

The stacking/bundling means 203 includes the stacking/bundling device 5, the rejected-note stacking device 6 and a stacking/bundling device control unit 203*a* which controls the operations of these two devices 5 and 6. The stacking/bundling device control unit 203*a* is connected to the system overall control unit 200, receives an instruction for bundling from the system overall control unit 200, and controls the bundling devices 51*c* to 55*c* so as to bundle units of 100 paper sheets P by paper bands, which are stacked in the associated stacking units 51*b* to 55*b*. After the bundles H are formed, the stacking/bundling device control unit 203*a* informs the system overall control unit 200 of the completion of the bundling.

The post-process means 204 includes the five chute devices 71 to 75, first transfer conveyor 76, second transfer conveyor 77, a large-band binding device, and a post-process control unit 204*a* which controls the operations of these devices. The post-process control unit 204*a* functions as a memory unit, a length detection unit and a bundle inspection unit of the present invention. The post-process control unit 204*a* is connected to the system overall control unit 200 and receives an instruction for conveyance from the system overall control unit 200, thereby controlling the respective devices.

In particular, the post-process control unit 204*a* monitors an output from the transmission sensor 79 that is disposed at a position along the second transfer conveyor 77. Triggered by the detection of the bundle H that is previously released from the chute device onto the first transfer conveyor 76, the post-process control unit 204*a* controls the driving mechanism of the chute devices 71 to 75 so as to release the next bundle H onto the first transfer conveyor 76. In other words, in this processing apparatus 100, the operations of the chute devices 71 to 75 are always controlled so as not to release two or more bundles H onto the first transfer conveyor 76, and the temporarily held bundles H are released at proper timing.

Figure 3:
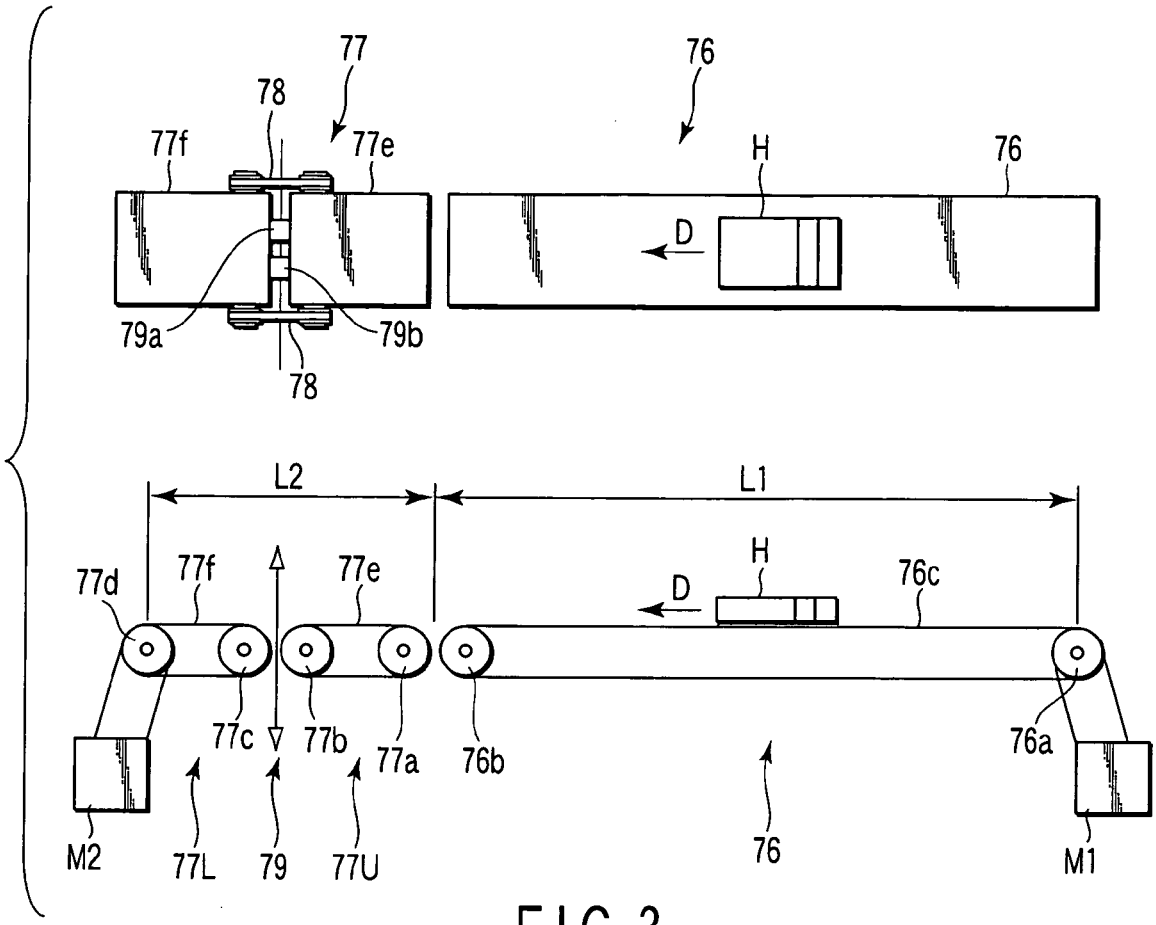
FIG. 3 is a schematic view of a convey device which is incorporated in the apparatus shown in FIG. 1.

FIG. 3 is a schematic view of the above-described first transfer conveyor 76 and second transfer conveyor 77. The bundle H, which is released onto the first transfer conveyor 76 via the chute device, 71 to 75, is conveyed in a direction D in FIG. 3 by the first transfer conveyor 76 and second transfer conveyor 77 while the speed of conveyance of the bundle H is varied during the conveyance. Specifically, the bundle H is transferred from the first transfer conveyor 76, on which the bundle H is conveyed at a relatively high speed, to the second transfer conveyor 77 on which the bundle H is conveyed at a relatively low speed, and thus the bundle H is conveyed with the speed of conveyance being decreased.

The first transfer conveyor 76 on the upstream side in the direction of conveyance of the bundle H (direction D) includes two rollers 76*a*, 76*b* which are spaced apart in the direction of conveyance; an endless flat belt 76*c* which is wound around, and passed between, the two rollers; and a driving motor M1 which rotates and drives one of the rollers, 76*a*.

The downstream-side second transfer conveyor 77, as described above, includes the upstream conveyor 77U which neighbors the roller 76*b* of the first transfer conveyor 76 and is disposed on the downstream side of the first transfer conveyor 76 in succession with the first transfer conveyor 76; the downstream conveyor 77L which is disposed on the downstream side of the upstream conveyor 77U in succession with the upstream conveyor 77U with a gap provided between the upstream conveyor 77U and downstream conveyor 77L; and the coupling device 78 which couples the two conveyors 77U and 77L so as to synchronously drive the two conveyors 77U and 77L. The transmission sensor 79 is disposed in the gap between the upstream conveyor 77U and downstream conveyor 77L.

The upstream conveyor 77U includes two rollers 77*a*, 77*b* which are spaced apart in the direction of conveyance, and an endless flat belt 77*e* which is wound around, and passed between, these two rollers. On the other hand, the downstream conveyor 77L includes two rollers 77*c*, 77*d* which are spaced apart in the direction of conveyance; an endless flat belt 77*f* which is wound around, and passed between, these two rollers; and a driving motor M2 which rotates and drives one of the rollers, 77*d*.

The coupling device 78, which couples the upstream conveyor 77U and downstream conveyor 77L, includes a plurality of pulleys and a plurality of drive belts, which couple the roller 77*b* of the upstream conveyor 77U and the roller 77*c* of the downstream conveyor 77L. The coupling device 78 functions to transmit a driving force of the downstream conveyor 77L, which is produced by the driving motor M2, to the upstream conveyor 77U.

In this embodiment, the speed of conveyance of the bundle H by the first transfer conveyor 76 is set at 666 [mm/s], and the speed of conveyance of the bundle H by the second transfer conveyor 77 (i.e. the upstream conveyor 77U and downstream conveyor 77L) is set at 333 [mm/s]. In this embodiment, the motors M1 and M2 are driven and controlled so as to set the running speeds of the conveyors 76 and 77 at the above-mentioned values, respectively.

For example, in the case where a transmission sensor is provided at a position along the first transfer conveyor 76 that is run at a relatively high speed and the length of the bundle H in the direction of conveyance, which is conveyed by the first transfer conveyor 76, is measured, the precision Ac1 of measurement is 0.666 [mm] if the sampling cycle of the detection signal is set at 1 [ms], as has been described in the "BACKGROUND OF THE INVENTION".

On the other hand, in the case where the transmission sensor 79 is provided at a position along the second transfer conveyor 77 that is run at a relatively low speed and the length of the bundle H in the direction of conveyance, which is conveyed by the second transfer conveyor 77, is measured, the precision Ac2 of measurement is 0.333 [mm] if the sampling cycle of the detection signal is similarly set at 1 [ms]. In short, by detecting the bundle H which is moving on the second transfer conveyor 77 at the low conveyance speed, the precision of measurement can be enhanced.

The precision of measurement, Ac1, Ac2, can be replaced with a measurement value Lc1, Lc2, which is obtained by measuring the time, during which the conveyed bundle H shuts off the optical axis of the transmission sensor 79, by using 1 [ms] cycle clock pulses CK. It can be said that the precision of measurement is higher as the number of samplings of the detection signal for the same bundle H is greater. In short, in the case where the length of the bundle H is measured by using the transmission sensor 79 that is disposed at the fixed position, the precision of measurement becomes higher as the conveyance speed of the bundle H is lower.

In the present embodiment, the conveyance speed of the bundle H on the second transfer conveyor 77, which is provided separately from the first transfer conveyor 76, is decreased to ½ of the process speed (666 [mm/s]) of the processing apparatus 100, and the length of the bundle H is measured by the transmission sensor 79. Thus, according to the processing apparatus 100 of the embodiment, the precision of measurement of the length of the bundle H was successfully increased two times higher, without varying the process speed. The processing apparatus 100 of this embodiment is suited to the inspection of the bundled state of the bundle H of paper sheets P, such as securities, which require a high-precision inspection.

Next, the method of inspecting the bundled state of the bundle by using the transmission sensor 79 is described.

In the processing apparatus 100 of this embodiment, for example, when the bundle H which is temporarily held by the chute device, 71 to 75, is released, it is possible that the released bundle H hits upon the first transfer conveyor 76*b* by falling and the bundled state of the bundle H deteriorates. There are many other factors of deterioration in the bundled state. In particular, in this embodiment, the bundle H is formed by winding the paper band along the transverse direction of paper sheets P. If the bundled state of the bundle H deteriorates, the length in the longitudinal direction of the bundle H would increase.

Figure 4:
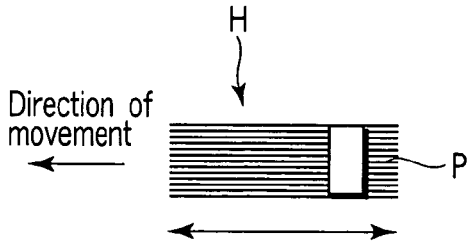
FIG. 4 is a schematic view showing an example of a bundle in a normal bundled state, which is conveyed by the conveyor shown in FIG. 3.
Figure 5:
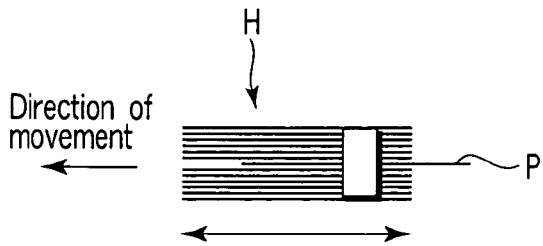
FIG. 5 is a schematic view showing an example of a bundle in an abnormal bundled state.
Figure 6:
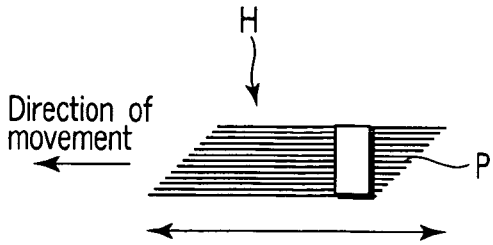
FIG. 6 is a schematic view showing another example of a bundle in an abnormal bundled state.

As shown in FIG. 4, in the case of the bundle H in the normal bundled state, the end portions of all of the 100 paper sheets P are aligned, and the length of the bundle H in the direction of conveyance corresponds to the length of the paper sheet P. In the case of the bundle H in the abnormal bundled state, as shown in FIG. 5 or FIG. 6, some of the paper sheets P project, or the bundle H deforms in an inclined fashion. As a result, the length of the bundle H in the direction of conveyance increases. Thus, by detecting the length of the bundle H in the direction of conveyance and comparing the detected length with a pre-measured normal value, abnormality in the bundled state can be inspected.

Specifically, in the post-process control unit 204*a*, the output of the transmission sensor 79 is monitored and the bundle H, which is conveyed at 333 [mm/s], is detected. At this time, the post-process control unit 204*a* measures the length of the bundle H by using 1 [ms] cycle clock pulses CK. The measured value Lsc corresponding to the length Ls of a standard bundle H and the measured value Lc corresponding to the length L of the detected bundle H are compared, and if a difference between both measured values is not greater than a tolerable value Lac, the detected bundle H is determined to be the bundle H in the normal bundled state.

Normal bundle: $|Lc-Lsc| \leqq Lac$

Abnormal bundle: $|Lc-Lsc| > Lac$

In a subsequent step, 10 normal bundles are bound by the large-band binding device. The abnormal bundle, which cannot be discharge as such, is separated from the post-process and is processed by an operator.

In the meantime, as in the above-described embodiment, if the speed of conveyance of the bundle H by the second transfer conveyor 77, which is disposed on the downstream side of the first transfer conveyor 76, is set to be lower than the transfer speed of the first transfer conveyor 76 that receives the bundle H from the chute devices 71 to 75 and conveys the bundle H, it is thinkable that the next bundle H is fed from the first transfer conveyor 76 to the second transfer conveyor 77 before the previous bundle H completely passes through the second transfer conveyor 77. If a plurality of bundles H are fed onto the second transfer conveyor 77 at the same time, the precision in measurement of the length of the bundle H may deteriorate.

Thus, in the present embodiment, some restrictions are imposed on the structure and operation of the processing apparatus 100 as will be described below.

First, the release timings of the bundles H by the chute devices 71 to 75 are controlled so as not to release tow or more bundles H onto the first transfer conveyor 76 at the same time, as described above. In other words, the release timings of the bundles H by the chute devices 71 to 75 are controlled so as to release a subsequent bundle H, which is one of two successively processed bundles H, onto the first transfer conveyor 76, upon being triggered when the preceding bundle H is detected by the transmission sensor 79 that is provided at a position along the second transfer conveyor 77.

Second, consideration is now given to a case in which the time from the release of the bundle H on the first transfer conveyor 76 to the transfer of the bundle H onto the second transfer conveyor 77 is shortest. Specifically, it is assumed that the bundle H is released from the chute device 71 which is disposed on the most downstream side in the direction of conveyance of the first transfer conveyor 76. Based on this assumption, the distance from the release position of the bundle H by the chute device 71 to the terminal end of the first transfer conveyor 76 and the length of the second transfer conveyor 77 along the direction of conveyance are set.

To be more specific, since the bundle H which is released from the most downstream chute device 71 is fed onto the second transfer conveyor 77 at an earliest timing, the distance from the release position of the bundle by the chute device 71 to the terminal end of the first transfer conveyor 76 and the length of the second transfer conveyor 77 along the direction of conveyance are set such that the time until the bundle H that is released from the chute device 71 is transferred onto the second transfer conveyor 77 becomes longer than, at least, the time until the bundle H that is transferred from the first transfer conveyor 76 onto the second transfer conveyor 77 completely passes through the second transfer conveyor 77.

The above restrictions on the dimensions of the respective components vary in accordance with the speed of conveyance of the bundle H by each conveyor 76, 77, and also varies due to slip between the bundle H and the transfer belt. Thus, in the present embodiment, the time until the bundle H released from the chute device 71 is transferred onto the second transfer conveyor 77 was actually measured, and the above-described dimensions were set on the basis of the actual measurement values.

Figures 7, 8:
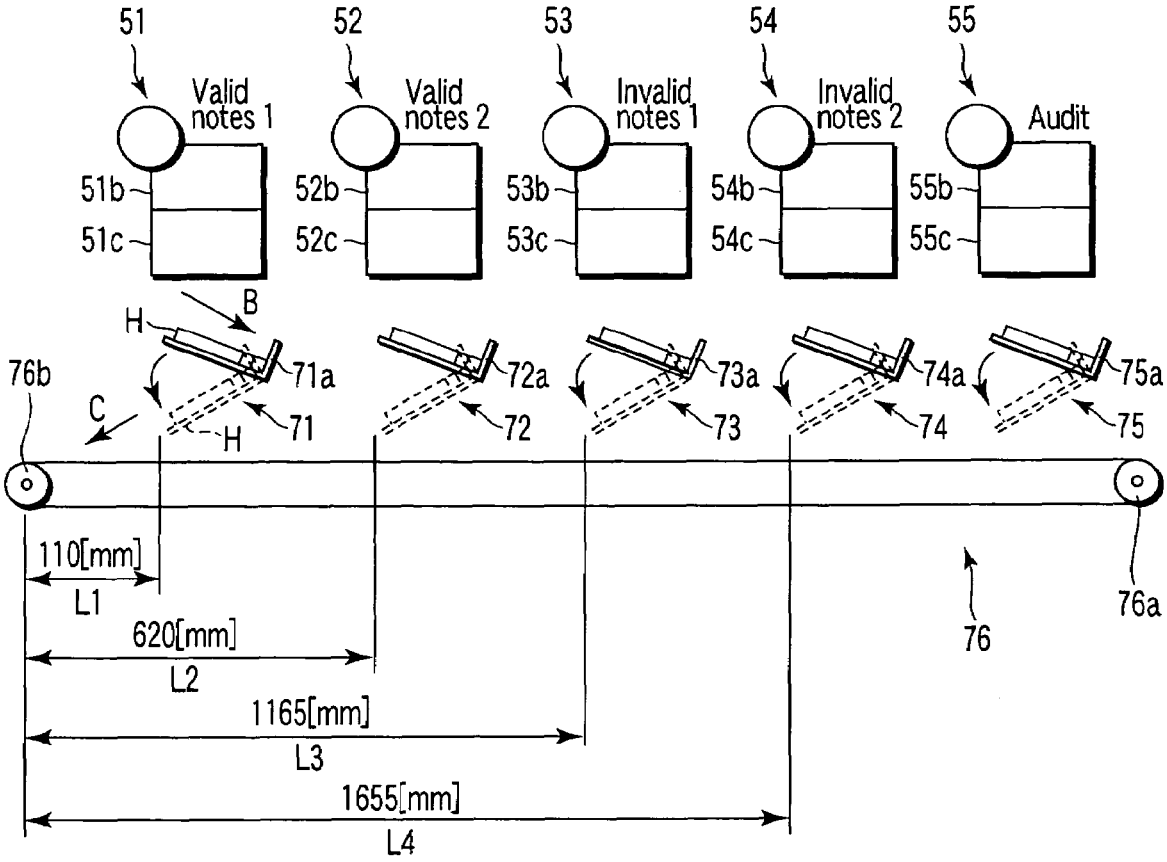
FIG. 7 is a schematic view showing a positional relationship between a plurality of chute devices which are incorporated in the apparatus shown in FIG. 1.
FIG. 8 is a table showing comparison results between theoretical values of time, during which a bundle, which is released from the chute device, passes through the conveyor, and actual measurement values.

FIG. 7 shows actual measurement values of distances from the release positions of the bundles H by the respective chute devices 71 to 74 to the terminal end of the first transfer conveyor 76. FIG. 8 is a table showing theoretical values (transfer time theoretical values) and actual measurement values (post-correction transfer times) of the transfer time until the bundles H released from the chute devices 71 to 74 are transferred onto the second transfer conveyor 77.

As is understood from the table of FIG. 8, the theoretical value of the transfer time until the bundle H released from the most downstream chute device 71 is transferred onto the second transfer conveyor 77 is 0.17 [s], while the actual measurement value of this transfer time is 1.47 [s]. In fact, immediately after the bundle H is released onto the first transfer conveyor 76, the transfer speed of the bundle H is not equal to the running speed (666 [mm/s] in this embodiment) of the first transfer conveyor 76. The transfer time becomes longer due to, e.g. slip between the bundle H and the first transfer conveyor 76. Thus, in the processing apparatus 100 of the present embodiment, the bundle H that is released from the chute device 71 is transferred onto the second transfer conveyor 77 after about 1.47 [s].

On the other hand, the bundle H that is transferred onto the second transfer conveyor 77 is conveyed at a reduced speed of 333 [mm/s]. In this embodiment, the length of the second transfer conveyor 77 is set at 400 [mm]. Thus, the bundle H, which is transferred onto the second transfer speed 77, completely passes through the second transfer conveyor 77 at least within 1.201 [s]. In other words, the bundle H, which is conveyed at a transfer speed of 666 [mm/s], has a transfer speed of about 666 [mm/s] at the time when the bundle H is transferred onto the second transfer conveyor 77. In the process of transfer of the bundle H onto the second transfer conveyor 77, the transfer speed of the bundle H is decelerated to 333 [mm/s]. Thus, immediately after the bundle H is transferred to the second transfer conveyor 77, the transfer speed of the bundle H is higher than 333 [mm/s], and the transfer time by the second transfer conveyor 77 becomes shorter by a degree corresponding to this higher transfer speed.

Therefore, in the processing apparatus 100 of this embodiment, the time T1=1.47 [s] (actual measurement value) until the bundle H released from the most downward chute device 71 is transferred onto the second transfer conveyor 77 is longer than the time T2=1.201 [s] until the bundle H that is transferred from the first transfer conveyor 76 completely passes through the second transfer conveyor 77, and a plurality of bundles H are not fed onto the second transfer conveyor 77 at the same time.

In other words, in the present embodiment, the distance from the release position of the bundle H by the chute device 71 to the terminal end of the first transfer conveyor 76 and the length of the second transfer conveyor 77 are set such that the time T1 until the bundle H released from the chute device 71 is transferred onto the second transfer conveyor 77 becomes longer than, at least, the time T2 until the bundle H that is transferred from the first transfer conveyor 76 completely passes through the second transfer conveyor 77.

According to the present embodiment, the precision of measurement of the length of the bundle at the time of inspecting the bundled state of the bundle can be enhanced without decreasing the process speed of the processing apparatus 100, that is, the running speed of the first transfer conveyor 76, and without decreasing the sampling cycle of the signal for detecting the bundle H.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, in the above-described embodiment, the running speed of the first transfer conveyor 76, onto which the bundle is released from the chute device, is set at 666 [mm/s] and the running speed of the second transfer conveyor 77, which receives the bundle from the first transfer conveyor 76 and conveys the bundle, is set at 333 [mm/s]. The running speeds are not limited to these values. It should suffice if the running speed of the second transfer conveyor 77 is lower than, at least, the running speed of the first transfer conveyor 76.

Besides, the distance from the release position of the bundle by the most downstream chute device 71 to the terminal end of the first transfer conveyor 76 and the length of the second transfer conveyor 77 are not limited to the values in the above embodiments. It should suffice if the time T1 until the bundle released from the chute device is transferred onto the second transfer conveyor is longer than, at least, the time T2 until the bundle that is transferred from the first transfer conveyor 76 completely passes through the second transfer conveyor 77.

What is claimed is:

1. A paper sheet processing apparatus comprising:

a take-out/transfer unit which takes out input paper sheets one by one onto a transfer path and transfers the paper sheets;

a paper sheet inspection unit which inspects the paper sheets that are transferred by the take-out/transfer unit via the transfer path;

a sorting/stacking unit which selectively sorts and stacks the paper sheets, which are transferred via the transfer path, into a plurality of sorting sections, which are juxtaposed along a direction of transfer of the paper sheets, on the basis of an inspection result in the paper sheet inspection unit;

a plurality of bundling units which bundle the paper sheets, which are sorted and stacked into the plurality of sorting sections, in units of a predetermined number of paper sheets;

a control unit that communicates and controls the take-out/transfer unit, paper sheet inspection unit, sorting/stacking unit, and plurality of bundling units;

a plurality of temporary hold units which receive and temporarily hold bundles that are formed by the plurality of bundling units;

a first transfer conveyor which is provided to extend under the plurality of temporary hold units in a direction of arrangement of the plurality of temporary hold units, and conveys the bundle that is released from each of the temporary hold units and placed on the first transfer conveyor;

a second transfer conveyor which is disposed on a downstream side of the first transfer conveyor in a direction of conveyance of the first transfer conveyor in succession with the first transfer conveyor, and further conveys the bundle, which is transferred from the first transfer conveyor, at a speed of conveyance that is lower than a speed of conveyance of the bundle by the first transfer conveyor;

a memory unit which stores a pre-measured actual time until the bundle that is released from the temporary hold unit, which is located on a most downstream side in the direction of conveyance, is transferred onto the second transfer conveyor;

a sensor which detects passage of the bundle which is conveyed by the second transfer conveyor;

a length detection unit which detects a length of the bundle in the direction of conveyance on the basis of a time during which the sensor detects the passage of the bundle; and a bundle inspection unit which inspects a bundled state of the bundle on the basis of a detection result by the length detection unit, wherein the control unit controls bundle transfer speed in which a distance from a position of reception of the bundle from the temporary hold unit, which is located on the most downstream side, to a terminal end of the first transfer conveyor and a length of the second transfer conveyor in a direction of conveyance are set such that a time until the bundle, which is transferred from the first transfer conveyor onto the second transfer conveyor, is completely passed through the second transfer conveyor is shorter than a prestored time in the memory unit.

2. The paper sheet processing apparatus according to claim 1, wherein the plurality of temporary hold units are permitted to release a next said bundle, upon being triggered when the sensor detects a preceding said bundle which is released onto the first transfer conveyor.

3. The paper sheet processing apparatus according to claim 1, wherein the second transfer conveyor includes a first conveyor which is disposed on a downstream side in a direction of conveyance of the first transfer conveyor in succession with the first transfer conveyor; a second conveyor which is disposed on a downstream side in a direction of conveyance of the first conveyor in succession with the first conveyor with a gap provided between the first conveyor and the second conveyor; and a coupling device which couples the first conveyor and the second conveyor such that the first conveyor and the second conveyor have the same speed of conveyance.

4. The paper sheet processing apparatus according to claim 3, wherein the sensor detects the bundle which passes through the gap between the first conveyor and the second conveyor.

* * * * *